United States Patent [19]

Elder et al.

[11] Patent Number: 4,853,990

[45] Date of Patent: Aug. 8, 1989

[54] MECHANICAL BACKLIFT

[75] Inventors: William H. Elder, Mandeville; Ries B. Hansen; André W. Olivier, both of New Orleans, all of La.

[73] Assignee: Mechanical Backrest, Inc., Mandeville, La.

[21] Appl. No.: 306,910

[22] Filed: Feb. 3, 1989

Related U.S. Application Data

[63] Continuation-in-part of Ser. No. 947,267, Dec. 29, 1986, abandoned.

[51] Int. Cl.[4] ..... A47C 20/04; A61G 7/06

[52] U.S. Cl. ..... 5/71; 5/433; 5/74 B

[58] Field of Search ..... 5/71, 72, 74 R, 74 B, 5/75, 79, 80, 433, 443; 108/4, 7, 8, 10; 248/394, 396, 422

[56] References Cited

U.S. PATENT DOCUMENTS

| | | | |
|---|---|---|---|
| Re. 26,411 | 6/1968 | Alsobrook, Jr. . | |
| 346,246 | 7/1886 | Uhde . | |
| 885,388 | 4/1908 | Sickles . | |
| 1,336,294 | 4/1920 | Hackman . | |
| 1,695,772 | 12/1928 | Mingle et al. . | |
| 2,187,312 | 1/1940 | Goodlake | 108/7 |
| 2,902,701 | 9/1959 | Driskill . | |
| 3,277,501 | 10/1956 | Frisz et al. . | |
| 3,310,289 | 3/1967 | Burke . | |
| 3,405,900 | 10/1968 | Robinson . | |
| 3,781,928 | 1/1974 | Swallert . | |
| 4,539,913 | 9/1985 | Marchant | 108/7 |

FOREIGN PATENT DOCUMENTS

| | | |
|---|---|---|
| 520169 | 1/1956 | Canada . |
| 347954 | 3/1900 | France . |
| 49856 | 8/1939 | France . |
| 252250 | 3/1927 | Italy . |
| 556760 | 2/1957 | Italy . |
| 2681 | 11/1890 | Switzerland . |
| 36348 | 2/1906 | Switzerland . |

*Primary Examiner*—Gary L. Smith
*Assistant Examiner*—Eric K. Nicholson
*Attorney, Agent, or Firm*—Pravel, Gambrell, Hewitt, Kimball & Krieger

[57] ABSTRACT

A person-raising device, designed for lifting a person in bed, rests atop a bed and is activated by a linear actuator comprising a dual-threaded lead screw and a small electric motor and gear reduction unit. The small electric motor and gear reduction unit drives the dual-threaded lead screw to raise a pair of support arms, which raises a person resting on the device. The lead screw is enclosed in a slotted tube; this decreases the chance of the lead screw coming into contact with a person using the device.

13 Claims, 5 Drawing Sheets

MECHANICAL BACKLIFT

This is a Continuation-in-Part of U.S. patent application Ser. No. 06/947,267, filed Dec. 29, 1986 now abandoned, hereby incorporated by reference.

BACKGROUND OF THE INVENTION

1. Field of the Invention

This invention relates generally adjustable mechanical backrests.

2. General Background

There are numerous devices available for the support and lifting of persons in a bed. These prior devices are generally expensive, cumbersome, and, of necessity to their basic design, permanently affixed to the bed they are attached to.

Although there are numerous mechanical, hydraulic, electric and other bedlift means, the prior art deals almost exclusively with means of raising a bed.

The invention claimed herein utilizes a scissor-jack type of lifting to raise a person on a bed. Scissors-type bed-lifts include Dufour, Fr. Pat. No. 49,856, Gertler Can. Pat. No. 520,169, Burke, U.S. Pat. Nos. 3,310,289, Driskill, 2,902,701, and Uhde, 346,246.

The above-mentioned patents share the quality of being permanently attached to the bedframe or are involved in the lifting of the entire bedframe. The claimed invention is a portable device which does not attach to the bedframe and does not become a part thereof. Furthermore, the claimed invention is powered electrically as opposed to the means employed in the cited patents.

Lifting devices which are not a part of the bedframe include Alsobrook, U.S. Pat. No. Re. 26,411 and Swallert, U.S. Pat. No. 3,781,928.

The current device uses an electric motor to power a scissors-type lifting action directly underneath a person in a bed and is easily portable from one bed surface to another. Furthermore, the claimed invention only lifts half of a person's body on a bed or other reclining surface.

SUMMARY OF THE PRESENT INVENTION

It is an object of this invention to provide a simple, light, portable means of raising the upper portion or lower portion of a person who is in a reclining position.

The invention is a new concept in the field of hospital and speciality orthopedic beds incorporating the comfort and convenience of a tilting or elevating feature. More specifically, this device is a mechanical backrest used to elevate the user that is itself not part of the bedframe but is portable, versatile and more affordable relative to beds incorporating mechanical components into the frame to achieve the same effect. It is this feature of portability that isolates the device from the characteristics of the bed or surface upon which it would be placed. The device itself is compact, self-contained, inexpensive unit.

The unit itself is based on the operation of a dual threaded lead screw, which is incorporated into a linear actuator, in which the lead screw is enclosed within the framework of bedlift.

The linear actuator preferably includes a small electric motor. Activation of the actuator motor results in opposite linear translation of two threaded collars on the lead screw that are in turn connected to a linkage of lifting arms that act in a scissors-jack fashion to elevate the user.

These and other objects of this invention will be readily apparent to those skilled in the art from the detailed description and claims which follow.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
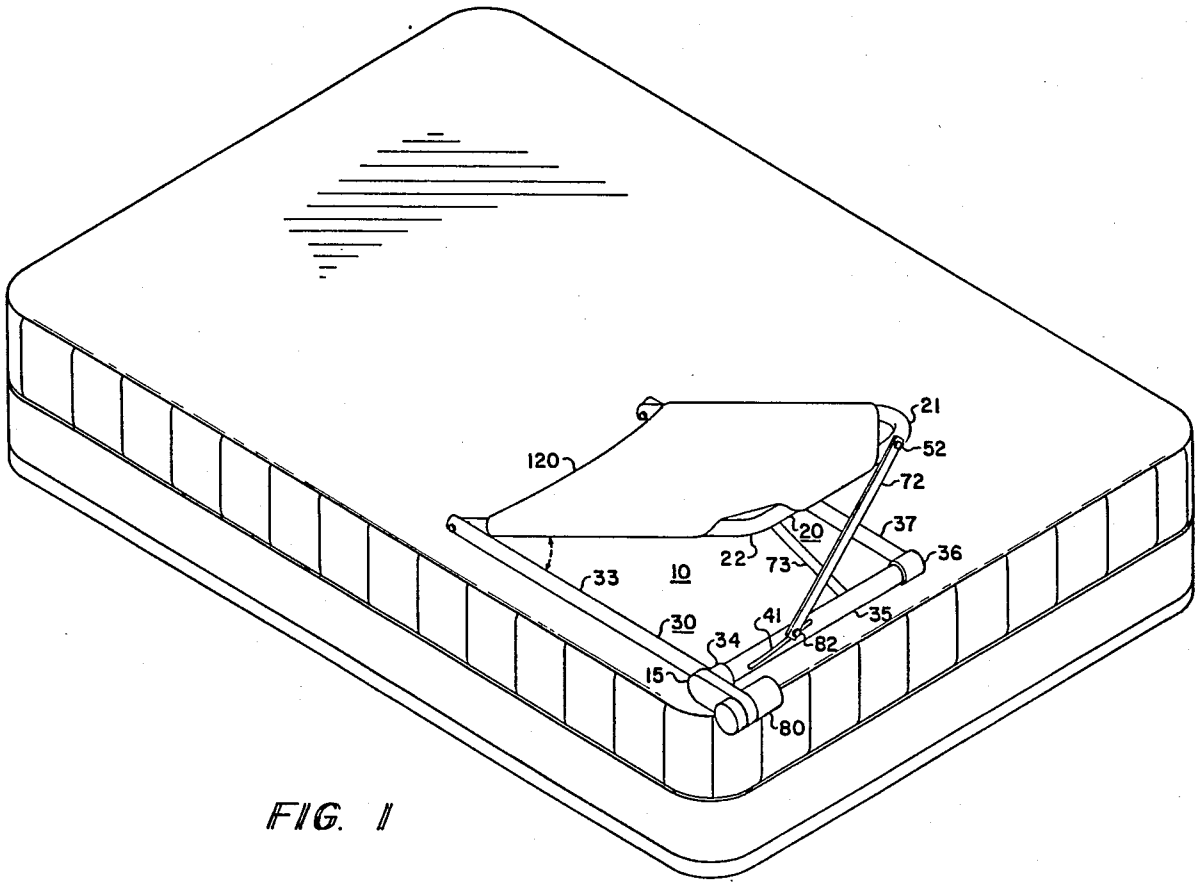
FIG. 1 is a perspective view showing the assembled device in operation.
Figure 2:
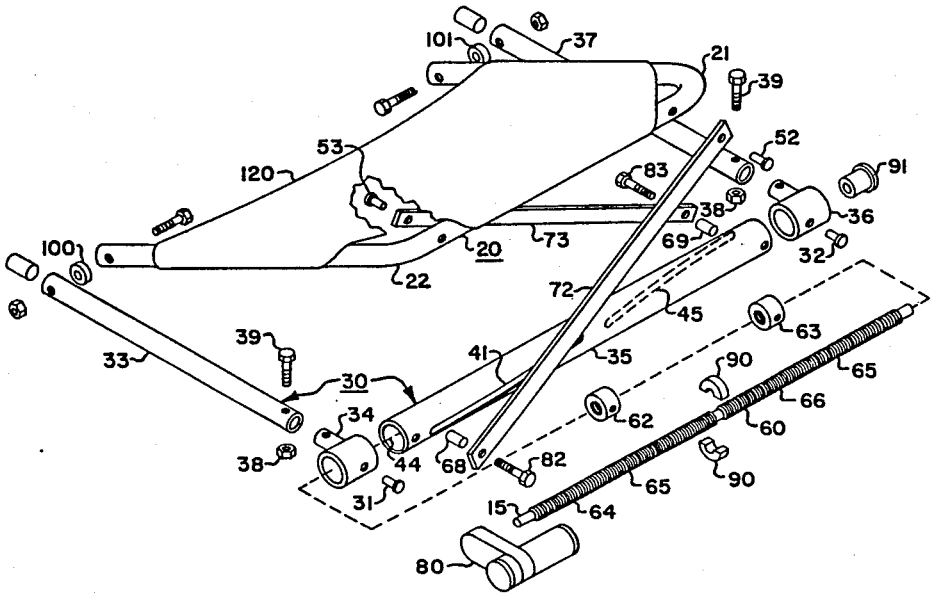
FIG. 2 is an isomeric drawing showing the operational parts of the invention.
Figure 3:
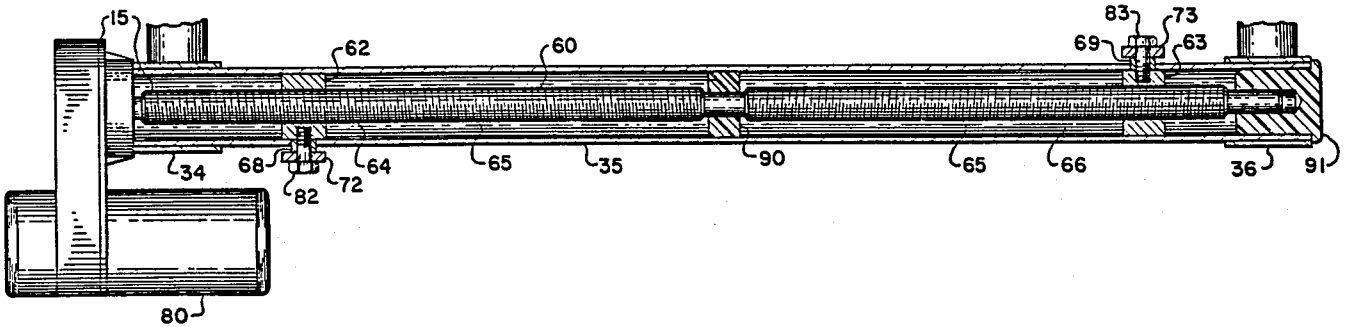
FIG. 3 is a block diagram showing a cut-away top view of the lead screw enclosed within the lower frame.
Figure 4:
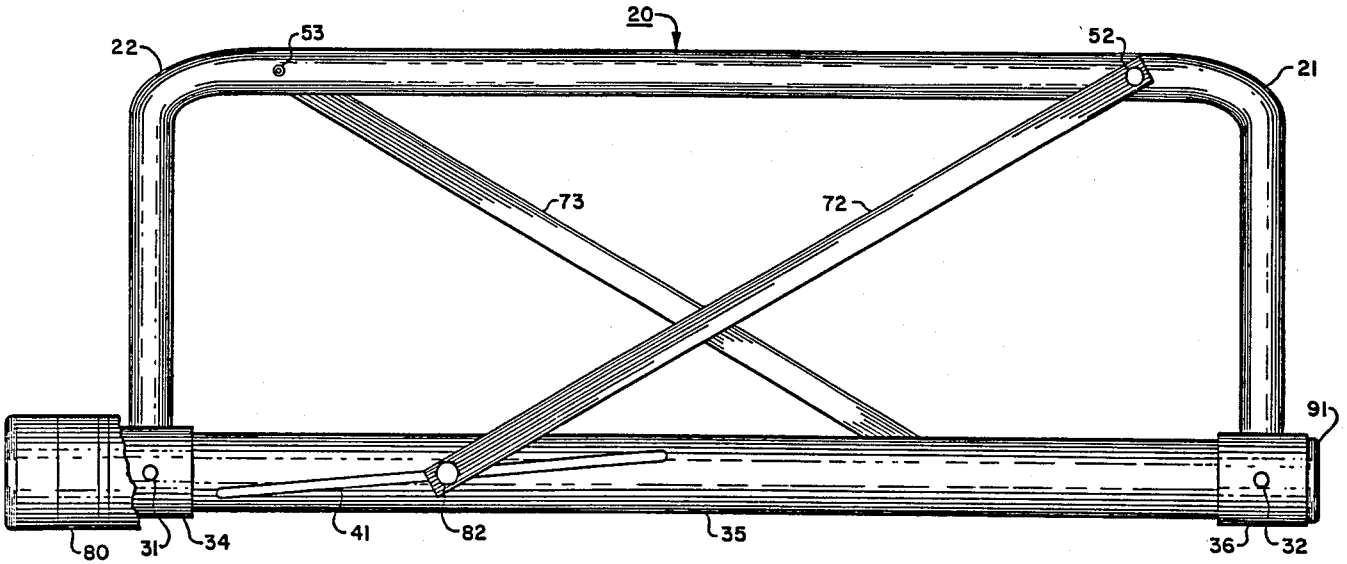
FIG. 4 is a block rear-end view of the device in operation.

The superstructure of the backrest 10 comprises first and second sub-assemblies 20 and 30. First sub-assembly 20 is the upper component and second sub-assembly 30 is the lower component. First sub-assembly 20 is made of one solid element and has two 90 degree angles 21 and 22 so as to form a "U".

Second sub-assembly 30 is substantially similar in shape to sub-assembly 20 but is composed of distinct tubes 33, 35, and 37. Tubes 33 and 37 are identical to each other and are each attached to tee-fittings 34 and 36 respectively by nut-and-bolt means 38 and 39 respectively. Tee-fittings 34 and 36 are attached at opposite ends of tube 35 by rivet means 31 and 32.

Tube 35 has slot means, slots 41 and 45, therein. Slots 41 and 45 are oriented approximately parallel to the longitudinal axis 44 of tube 35.

Present within tube 35 is lead screw 60, the drive shaft of the electric motor and gear reduction unit 80. The lead screw 60 comprises right-hand threads 64 and left-hand threads 66. Threaded collars 62 and 63 are threaded such as to rotate about each set of threads 64 and 66. Bolts 82 and 83 are affixed to collars or collar members 62 and 63 respectively. Friction sleeves 68 and 69 respectively are inserted into bolts 82 and 83, to allow for translational movement through slots 41 and 45.

Sub-assemblies 20 and 30 are permanently and rotatably attached through pivot means 100 and 101 adjacent a first end of first sub-assembly 20.

Bolts 82 and 83 pass through holes in the second ends of support members 72 and 73, respectively, pivotally connecting the second ends of support members 72 and 73 to collar members 62 and 63, respectively. The first ends of support members 72 and 73 are permanently pivotally attached to first sub-assembly 20 adjacent its second end by rivet means 52 and 53, respectively.

A nylon support bearing 90 is placed within tube 35 along actuator shaft 60 between screw means 65. A nylon bearing 91 is placed at the open end of tee-fitting 36.

The entire assembly is driven by linear actuator 15 comprising lead screw 60 and motor and gear reduction unit 80.

Figure 5:
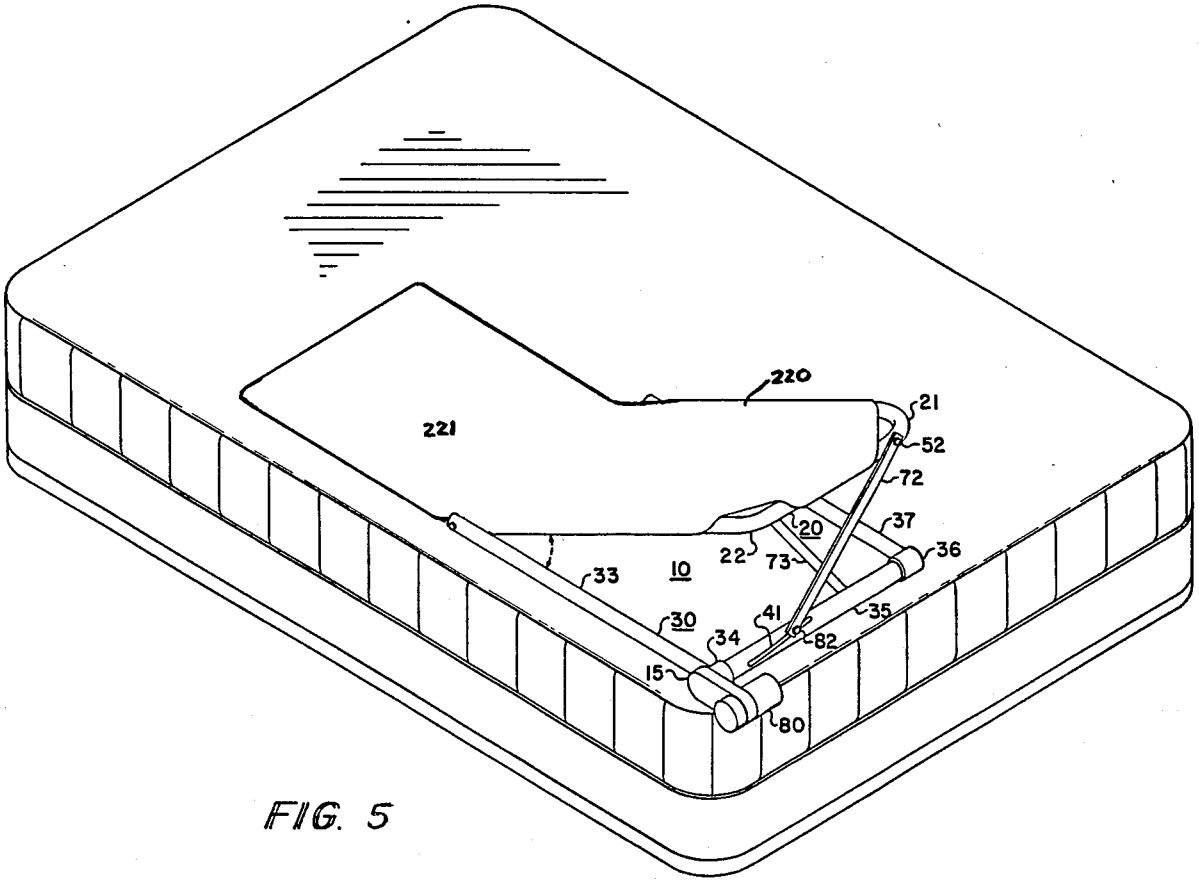
FIG. 5 is a perspective view of an alternative embodiment of the present invention.

FIG. 5 shows the device of the present invention with a piece of fabric 220 replacing the piece of fabric 120 shown in FIG. 1. Piece of fabric 220, like piece of fabric 120, covers sub-assembly 20, but additionally includes a portion 221 which extends from the first end of first sub-assembly 20 in a direction away from the second end of first sub-assembly 20. Portion 221 is a "fanny-flap". When a person lays on device 10 with his back on sub-assembly 20, the weight of his body on portion 221 increases the frictional resistance to horizontal movement of device 10, which helps prevent device 10 from sliding off of a bed.

When it is desired to raise sub-assembly 20, a switch (not shown) is flipped to a first position, or other control means are used, to cause motor and gear reduction unit 80 to rotate lead screw 60 in a first direction. As lead screw 60 rotates in a first direction, threaded collar members 62 and 63 move toward one another, causing the lower, second ends of support members 72 and 73 to move relative to one another (toward one another) such that the second ends of the first and second sub-assemblies 20 and 30, respectively, move away from one another. When it is desired to lower sub-assembly 20, a switch (not shown) is flipped to a second position, or some other control means are used, to cause motor and gear reduction unit 80 to rotate lead screw 60 in a second direction.

Although slots 41 and 45 are shown on opposite sides of tube 35, and the first ends of support members 72 and 73 are shown on opposite sides of the tube making up sub-assembly 20, slots 41 and 45 could both be present on the same side of tube 35, and the first ends of support members 72 and 73 could both be on the same side of the tube making up sub-assembly 20.

When it is desired to have sub-assembly 20 fold down as flat as possible, it is advantageous to add brackets extending vertically upward from sub-assembly 20, and to connect support members 72 and 73 to the brackets, rather than directly to sub-assembly 20, so that linear actuator 15 will not bind when it is desired to raise sub-assembly 20 from a flat position.

It is to be understood that the forms of the invention herein shown and described are to be taken as preferred examples of the same, and that various changes in the shape, size, and arrangement of parts may be resorted to, without departing from the spirit of the invention or scope of the claims.

What is claimed as invention is:

1. A device for raising and supporting a portion of a person, comprising:

(a) a frame means comprising a first sub-assembly having first and second ends and a second sub-assembly having first and second ends, the first sub-assembly being pivotally attached adjacent the first end thereof to the second sub-assembly;

(b) a linear actuator comprising:

(i) a lead screw contained within a tube in the second sub-assembly adjacent the second end of the second sub-assembly; and (ii) means for rotating the lead screw, the lead screw having first and second halves, the first half having right-hand threads therein and the second half having left-hand threads, the tube having slot means therein;

(c) first and second support members, each having a first end and a second end, the first ends of the support members being pivotally attached to the first sub-assembly adjacent the second end of the first sub-assembly;

(d) first and second threaded collar members, the first being threadably disposed on the first half of the lead screw and the second being threadably disposed on the second half of the lead screw;

(e) means for attaching the second end of the first support member to the first collar member through the slot means; and (f) means for attaching the second end of the second support member to the second collar member through the slot means, wherein rotation of the lead screw in a first direction causes the second ends of the support members to move relative to one another such that the second ends of the first and second sub-assemblies move away from one another and rotation of the lead screw in a direction opposite the first direction causes the second ends of the support members to move relative to one another such that the second ends of the first and second sub-assemblies move toward one another.

2. The device of claim 1, wherein:

the means for rotating the lead screw comprises an electric motor.

3. The device of claim 1, further comprising:

a flexible flap means extending from the first end of the sub-assembly in a direction away from the second end of the first sub-assembly.

4. The device of claim 1, wherein:

the device has a first half and a second half;

the first end of the first support member and the second end of the second support member are on the first half of the device; and the second end of the first support member and the first end of the second support member are on the second half of the device.

5. The device of claim 1, wherein:

the first sub-assembly is covered with a piece of fabric.

6. The device of claim 5, wherein: the piece of fabric also extends from the first end of the first sub-assembly in a direction away from the second end of the first sub-assembly.

7. The device of claim 6, wherein:

the device has a first half and a second half;

the first end of the first support member and the second end of the second support member are on the first half of the device; and the second end of the first support member and the first end of the second support member are on the second half of the device.

8. The device of claim 7, wherein:

the means for rotating the lead screw comprises an electric motor.

9. A device for raising and supporting a portion of a person, comprising:

(a) a frame means comprising a first sub-assembly having first and second ends and a second sub-assembly having first and second ends, the first sub-assembly being pivotally attached adjacent the first end thereof to the second sub-assembly;

(b) a linear actuator comprising:

(i) a lead screw contained within a tube in the second sub-assembly adjacent the second end of the second sub-assembly; and (ii) an electric motor for rotating the lead screw, the lead screw having first and second halves, the first half having right-hand threads therein and the second half having left-hand threads, the tube having slot means therein;

(c) first and second support members, each having a first end and a second end, the first ends of the support members being pivotally attached to the first sub-assembly adjacent the second end of the first sub-assembly;

(d) first and second threaded collar members, the first being threadably disposed on the first half of the lead screw and the second being threadably disposed on the second half of the lead screw;

(e) means for attaching the second end of the first support member to the first collar member through the slot means;

(f) means for attaching the second end of the second support member to the second collar member through the slot means; and (g) a flexible flap means extending from the first end of the sub-assembly in a direction away from the second end of the first sub-assembly, wherein rotation of the lead screw in a first direction causes the second ends of the support members to move relative to one another such that the second ends of the first and second sub-assemblies move away from one another and rotation of the lead screw in a direction opposite the first direction causes the second ends of the support members to move relative to one another such that the second ends of the first and second sub-assemblies move toward one another.

10. The device of claim 9, wherein:

the device has a first half and a second half;

the first end of the first support member and the second end of the second support member are on the first half of the device; and the second end of the first support member and the first end of the second support member are on the second half of the device.

11. The device of claim 9, wherein:

the first sub-assembly is covered with a piece of fabric.

12. The device of claim 11, wherein: the flexible flap means comprises a portion of the piece of fabric which extends from the first end of the first sub-assembly in a direction away from the second end of the first sub-assembly.

13. The device of claim 12, wherein:

the device has a first half and a second half;

the first end of the first support member and the second end of the second support member are on the first half of the device; and the second end of the first support member and the first end of the second support member are on the second half of the device.

* * * * *